US006829854B2

(12) United States Patent
Reynolds

(10) Patent No.: US 6,829,854 B2
(45) **Date of Patent: *Dec. 14, 2004**

(54) LIGHTED FLEXIBLE DISPLAY DEVICE HAVING A BATTERY SUPPLY MOUNT

(76) Inventor: Randy B. Reynolds, 2862 Calle Las Casitas, St. George, UT (US) 84790

( * ) Notice: Subject to any disclaimer, the term of this patent is extended or adjusted under 35 U.S.C. 154(b) by 80 days.

This patent is subject to a terminal disclaimer.

(21) Appl. No.: 09/811,993

(22) Filed: Mar. 19, 2001

(65) Prior Publication Data

US 2001/0020343 A1 Sep. 13, 2001

Related U.S. Application Data

(63) Continuation of application No. 09/434,877, filed on Nov. 5, 1999, now abandoned, which is a continuation of application No. 09/233,998, filed on Jan. 19, 1999, now abandoned, which is a continuation of application No. 08/910,700, filed on Aug. 13, 1997, now abandoned, which is a continuation of application No. 08/406,752, filed on Mar. 6, 1995, now Pat. No. 6,438,882, which is a continuation-in-part of application No. 08/058,197, filed on May 4, 1993, now abandoned, which is a continuation of application No. 07/826,491, filed on Jan. 27, 1992, now Pat. No. 5,233,773, which is a continuation-in-part of application No. 07/536,765, filed on Jun. 11, 1990, now Pat. No. 5,111,606.

(51) Int. Cl.[7] ..... G09F 3/18

(52) U.S. Cl. ..... 40/642.02; 40/661.03; 40/715; 248/900

(58) Field of Search ..... 40/5, 442, 608, 40/642.02, 649, 651, 661.03, 666, 714, 715; 248/289.31, 900; 362/184, 369, 800

(56) References Cited

U.S. PATENT DOCUMENTS

| | | | | | |
|---|---|---|---|---|---|
| 690,649 | A | * | 1/1902 | Goehst | 40/541 |
| 900,590 | A | | 10/1908 | Raymond | |
| 1,266,152 | A | * | 5/1918 | Poole | 40/608 |
| 1,367,830 | A | * | 2/1921 | Poole | 40/608 |

(List continued on next page.)

FOREIGN PATENT DOCUMENTS

| | | | | |
|---|---|---|---|---|
| DE | 497867 | * | 5/1930 | 248/291 |
| GB | 469487 | | 1/1914 | |

*Primary Examiner*—Brian K. Green
(74) *Attorney, Agent, or Firm*—Lynn G. Foster

(57) ABSTRACT

A lighted flexible display device or sign, useful for advertising purposes, and having a battery supply mount. The display device herein is a lighted display and is constructed to be flexible in the presence of inadvertent bumping or deflection thereof. The mounting resilient such that, when the deflecting force is removed, the sign springs back to its normal lateral position. The mount for the display device includes a battery supply, with such supply being electrically connected to the electrical circuit of the sign. This is accomplished by means of electrical leads passing through a deflection restoration spring, by such leads passing through a resilient tongue, or with connectors used in a spring-biased pivotal construction for connecting the battery supply to the electrical lighting circuit of the sign.

2 Claims, 14 Drawing Sheets

U.S. PATENT DOCUMENTS 1,402,105 A * 1/1922 Spelling ..... 40/608
1,410,662 A 3/1922 Even
1,412,580 A 4/1922 Thayer
1,439,101 A * 12/1922 Hatcher ..... 40/608
1,443,204 A * 1/1923 Bernstein ..... 40/608
1,760,270 A * 5/1930 Griswold ..... 40/608
1,886,004 A * 11/1932 Geyser ..... 40/608
1,903,683 A * 4/1933 Nute ..... 40/608
2,541,303 A 2/1951 Smith
2,654,172 A 10/1953 Solomon
2,787,433 A 4/1957 Slavsky
2,817,131 A 12/1957 Seegers
2,924,902 A 2/1960 Luck et al.
3,015,177 A * 1/1962 Hembd et al. ..... 248/231.21 X
3,041,760 A 7/1962 Slavsky
3,070,911 A 1/1963 Slavsky
3,084,463 A 4/1963 Guyer et al.
3,189,187 A * 6/1965 Guyer, Jr. et al. .. 248/231.21 X
3,226,866 A 1/1966 Kuczewski de Poray
3,517,937 A 6/1970 Glass et al.
3,696,541 A 10/1972 Pittman
3,931,689 A 1/1976 Shine
D243,639 S 3/1977 Escalante
4,028,828 A 6/1977 Chao et al.
D245,945 S 9/1977 Mihojevich
4,055,014 A 10/1977 Schmidt et al.
4,096,656 A 6/1978 Diceglie
4,317,303 A 3/1982 Sernovitz
4,682,430 A 7/1987 Ramsay
4,748,756 A * 6/1988 Ross ..... 40/715
4,805,331 A 2/1989 Boggess et al.
4,819,353 A 4/1989 Glucksman et al.
4,881,707 A 11/1989 Garfinkle
4,909,464 A 3/1990 Levine et al.
4,924,363 A 5/1990 Kornelson
4,984,693 A 1/1991 Belokin, Jr. et al.
4,991,338 A * 2/1991 Jones ..... 40/654.01 X
5,111,606 A 5/1992 Reynolds
5,233,773 A * 8/1993 Reynolds ..... 40/152.2 X
6,202,334 B1 * 3/2001 Reynolds et al. ..... 40/608 X

* cited by examiner

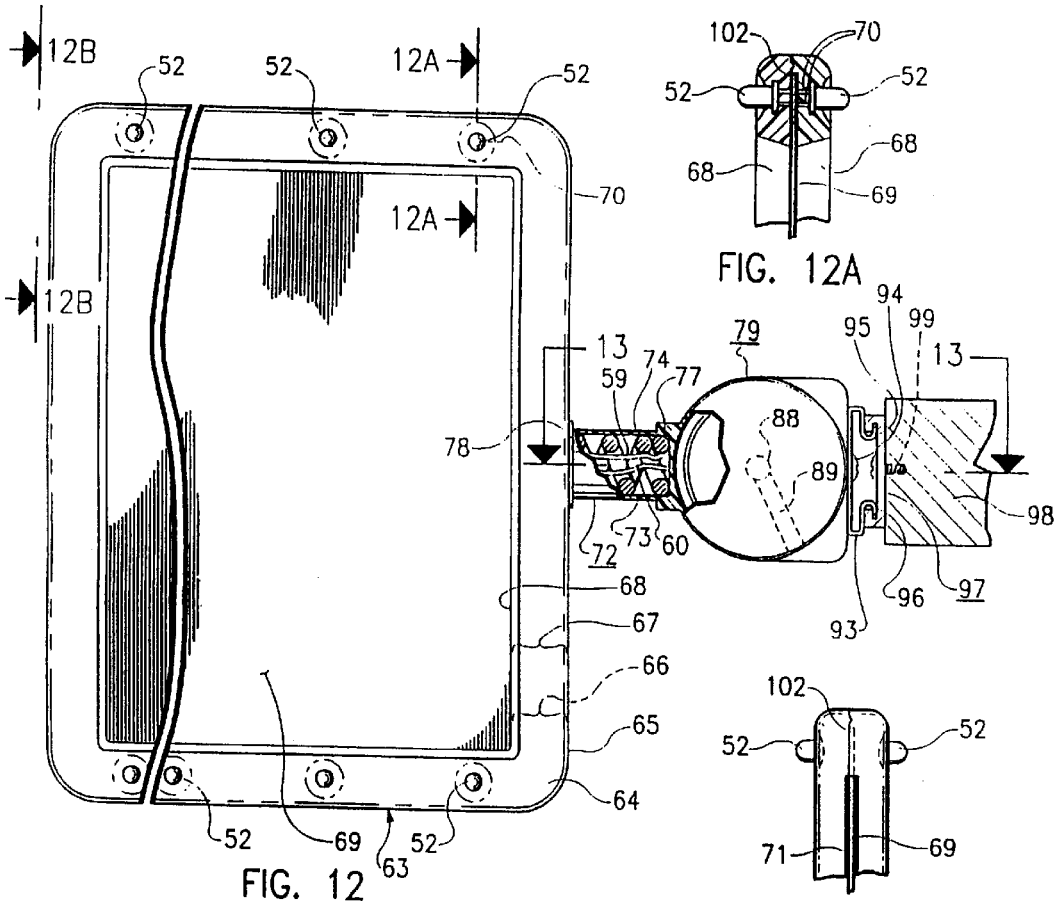
FIG. 12
FIG. 12A
FIG. 12B
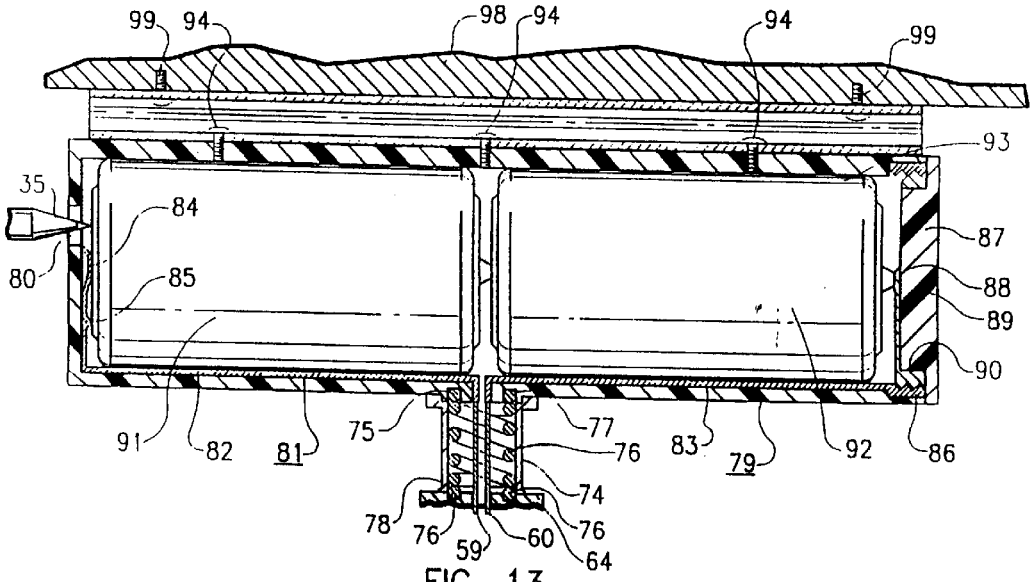
FIG. 13

LIGHTED FLEXIBLE DISPLAY DEVICE HAVING A BATTERY SUPPLY MOUNT

CONTINUITY

This application is a continuation of U.S. patent application Ser. No. 09/434,877, filed 5 Nov. 1999, now abandoned, which is a continuation of U.S. patent application Ser. No. 09/233,998, filed 19 Jan. 1999, now abandoned, which is a continuation of U.S. patent application Ser. No. 08/910,700, filed Aug. 13, 1997 now abandoned, which is a continuation of U.S. patent application Ser. No. 08/406,752, filed Mar. 6, 1995, now U.S. Pat. No. 6,438,882, which is a continuation-in-part of my U.S. patent application Ser. No. 08/058,197, filed May 4, 1993, now abandoned, which is a continuation of my U.S. patent application Ser. No. 07/826,491, filed Jan. 27, 1992, now U.S. Pat. No. 5,233,773, which issue Aug. 10, 1993, which is a continuation-in-part of U.S. patent application Ser. No. 07/536,765, filed Jun. 11, 1990, now U.S. Pat. No. 5,111,606, which issued May 12, 1992.

FIELD OF INVENTION

The present invention relates to lighted merchandising display devices for advertising purposes in stores and, more particularly, provides a flexible display device having a battery supply mount. The device is engineered and employed principally for locations in mercantile establishments such as grocery stores, supermarkets, discount centers, and the like.

BACKGROUND AND BRIEF DESCRIPTION OF PRIOR ART

In the past there have been several different types of approaches taken in advertising merchandise carried on grocery store shelves, in refrigerator cabinets, and so forth. Advertising media are important, of course, to draw the attention of shoppers to various specials, new items, and featured items for a particular sale. Merchandisers have noted the advantages of having lighted signs or sign displays proximate merchandise such as canned goods to be placed on special. Many conventional signs have their electrical circuits connected to an AC source; this is impractical, however, because the provision of multiple AC outlets along a very long shelf display becomes prohibitively expensive. Certain display signs carry a battery pack proximate the display area; however, this does interfere with the viewing of the sign, especially bi-directional viewing to accommodate customers. A further problem in the prior art is presented in the case of rigid signs which might be inadvertently bumped and possibly damaged should a rigid connection be maintained between the outwardly projecting sign and its mount to a shelf, for example. A certain flexibility feature relative to the sign and its mount to the shelf has been adopted in the past as is evidenced by U.S. Pat. Nos. 4,881,707 and 4,805,331; also, certain approaches have been taken in supplying battery power to signs, but which exclude practical application relative to the sign for bi-directional viewing, see U.S. Pat. Nos. 4,317,303 and 4,924,363.

For several reasons, and not believed disclosed in the prior art, what is needed is a battery supply proximate, i.e., at the mount of the device at the shelf proper, or the refrigerator enclosure which is to incorporate the sign. In this way both forward and rear surfaces of the outwardly projecting signs are completely free and unobstructed for viewing in either direction; this magnifies the uses of the sign for traffic in both directions in stores utilizing the device. A further feature which is needed, and not believed shown in the prior art, is the concept of having electrical connection from the battery station fixed adjacent to the shelf, to and through the flexible or articulative structure to the electrical circuit board of the sign proper. There is no art currently known to the inventor which teaches the concept of supplying electrical leads, for example, or other electrical connections between a battery supply mount and a flexible lighted sign, through a tongue, or spring, or articulative joint, so as to preserve resilience to the structure, and yet not interfere with sign lighting or the displacements and automatic restoration of the sign relative to its mount. A number (24) of U.S. patents are known which bear upon signs in general, however, and will be of interest and, to some small degree, relevant. These are as follows:

| | |
|---|---|
| 1. | Des 243,639 |
| 2. | Des 245,945 |
| 3. | 469,487 |
| 4. | 900,590 |
| 5. | 2,654,172 |
| 6. | 2,817,131 |
| 7. | 2,924,902 |
| 8. | 3,041,760 |
| 9. | 3,070,911 |
| 10. | 3,084,463 |
| 11. | 3,226,866 |
| 12. | 3,517,937 |
| 13. | 3,696,541 |
| 14. | 3,931,689 |
| 15. | 4,028,828 |
| 16. | 4,055,014 |
| 17. | 4,096,656 |
| 18. | 4,317,303 |
| 19. | 4,682,430 |
| 20. | 4,805,331 |
| 21. | 4,819,353 |
| 22. | 4,881,707 |
| 23. | 4,924,363 |
| 24. | 4,984,693 |

A primary difficulty with respect to traditional sign displays, particularly bi-directionally viewable sign displays located within aisles of a store, has been a need for the sign display to be flexible and resilient. It is desirable for the sign display to be deflectable in a horizontal or side-to-side direction in addition to being deflectable in an up-and-down or vertical direction. As such, the sign can be deflected regardless of the angle of impact (either from a shopping cart or a person) and resiliently returned to its original position.

Another traditional problem with respect to sign displays, again particularly bi-directionally viewable sign displays within an aisle of a shopping area, involves the impediment created by the sign display in stacking shelves and removing items from shelves. Such sign displays that are rectangular may extend above and below the particular shelf area to which it is attached. This can impede access to the shelf.

Still another problem with respect to sign displays relates to the presentation angle of the sign display so that it is pleasing from a marketing standpoint. Since particular sign displays may vary in terms of shape and size, it is desirable to have an ability to change the angle at which the sign display is positioned to provide a desirable presentation angle for marketing purposes.

With respect to illuminated sign displays in particular, the power supply, similar to the sign display, may impede access to shelf storage areas depending on the orientation of the power supply. There is therefore a need to incorporate a power supply into a sign display that minimizes impedance with access to shelf storage areas.

Another problem with respect to lighted sign displays is the light necessary for illuminating the sign display. Traditional sign displays have required several light sources. Therefore, each light source is susceptible to failure, which requires repair and/or replacement. The fewer light sources incorporated into the sign display, the fewer number of potential failures involved.

Another primary design concern with respect to sign displays is the attention it provides to the particular shelf to which it is attached. In a typical shopping aisle, there are so-called primary shelves and secondary shelves. The primary shelves are typically eye level and are the easiest, most convenient shelves for the shopper to view. The present invention is designed to overcome primary/secondary shelf distinction by rendering any shelf to which the sign display of the present invention is attached a primary shelf.

BRIEF DESCRIPTION AND OBJECTS OF THE INVENTION

In the present invention a lighted merchandising display includes its own individual electrical circuit such as a circuit board for powering lights disposed at the margins or about the periphery of the display, this preferably at opposite sides of the frame of the display. The display is of a slim-line design and has viewing windows on opposite sides of the frame so that advertising matter may be viewed from both sides of the display as customers are approaching the display. A battery pack, case or holder is provided and is directly mounted to the shelf molding of the display shelf, or also to the transparent door of a refrigerator or freezer, by way of example. The display frame relative to the battery pack is flexibly connected so as to allow for temporary deflections of the sign should passersby inadvertently bump the same and thus deflect the sign from its usual orthogonal position.

Accordingly, a coil deflection spring, a torsion spring, or a flexible resilient tongue is provided to contribute the flexibility needed relative to the display and its fixedly mounted battery pack. Electrical leads proceed through the tongue, spring, or articulative pivotal joint incorporating the torsion spring, so that electrical connection is always maintained between the battery pack and the sign whatever the temporary disposition of the frame of the device. Perforated ears and a pin element positioned therethrough are designed to releasably secure advertising cards within the frame of the display as well as serve other functions. The circuit board is preferably U-configured so as to provide for a convenient receptacle and the support for cards to be inserted in the frame and within the circuit board. The battery is maintained outside of the frame and its advertising display, and is proximate the mounting of the unit to external structure. This mounting is preferably adjustable but may be fixed and secure so as to eliminate the chancing of inadvertent dislodgment of the batteries, or its case. Of prime importance, and whether an articulative or pivotal joint is incorporated or some type of tongue, whether resilient and/or spring, the electrical connectors from the battery support maintain continuous communication via the tongue or spring, etc. whereby to facilitate continuous connection to the circuit board or other lighting circuit of the frame. In the above manner the frame of the device is made free of the battery pack so that it can insure a slim-line design and be functional bi-directionally at opposite sides of the frame as well as be flexible.

Another aspect of the present involves a tapered sign display having a relatively small section at a proximal end of the sign display and a relatively tall section at a distal end of the sign display. The tapered frame portion of the sign display is mounted to a battery pack oriented to coincide with the horizontal plane of the shelf to which the sign display is attached. As such, the sign display creates minimal interference with access to storage areas above and below the shelf.

Still another aspect of the present invention involves a resilient flexion joint interconnecting the sign display and the mounting mechanism for the sign display. The flexion joint allows for resilient movement of the sign display in side-to-side directions and in up-and-down directions.

Yet another aspect of the present invention involves an adjustment mechanism that allows the orientation of the sign display to be adjusted. That is, the presentation angle of the bi-directionally observable sign can be changed as desired.

Another aspect of the invention involves mounting a pair of lights within the tubular frame members of the sign display, and mounting respective parabolic reflectors at opposite ends of the tubes for illuminating the tubular frame portions of the sign display.

In view of the foregoing, it is a principal object of the present invention to provide a new and improved advertising display device.

A further object is to provide an advertising display device carrying its own battery pack and being suitable for attachment to the molding of a merchandise shelf, to the transparent door of a refrigerator or freezer, and so forth.

A further object is to provide a device having an articulative pivotal joint suitably spring-biased to provide a restoring force for the device frame to return the same to orthogonal projection subsequent to inadvertent bumping or displacements by customers, shopping carts, and the like.

An additional object is to provide a battery pack or battery holder mount for outwardly projecting display signs, wherein the battery pack mount includes the electrical connections which are maintained with the lighting circuit of the sign provided, even though such sign may be temporarily displaced from its intended orthogonal position.

A further object is to provide a means for securing cards in display signs, wherein the structure provided may also serve as a tag- or other sign-support.

Still another object of the invention is to provide a sign display that minimizes impedance with respect to access to shelf areas adjacent the sign display.

Another object of the invention is to provide an adjustment device for changing the presentation angle of the sign display.

Yet another object of the invention is to provide a sign display that is resiliently moveable in the side-to-side directions as well as the up-and-down directions.

Still another object of the invention is to provide a sign display that includes an integral power source aligned to correspond with the shelf area to which the sign display is attached.

Another object of the invention is to provide a sign display that minimizes the number of light sources used in connection with the sign display.

Still yet another object of the invention is to provide a sign display that renders the shelf to which it is attached a primary shelf in terms of customer attention and focus.

Other objects, features, and advantages of the present invention may best be understood by reference to the following detailed description, taken in conjunction with the accompanying drawings.

BRIEF DESCRIPTION OF THE DRAWINGS

Preferred embodiments of the invention are described below with reference to the accompanying drawings:

FIG. 12 is a fragmentary side elevation, shortened horizontally for convenience of illustration, of another embodiment of the invention illustration usage of a horizontal battery case which is part of the mount of the device, and incorporating a coil-spring tongue or extension connected to the device frame, carrying electrical leads to the circuit of the frame, and lending flexibility to the structure.

FIG. 12A is an enlarged fragmentary cross-section, taken along the line 12A—12A in FIG. 12, illustrating circuit-board insertion-receipt of the advertising card employed.

FIG. 12B is a partial end view, taken along the line 12B—12B, illustrating the slot receiving the advertising card for positioning within the frame of the device.

FIG. 13 is an enlarged horizontal section, taken along the line 13—13 in FIG. 12, illustrating the battery pack or holder and its mounting to a display shelf and its flexible securement to the display sign.

DETAILED DESCRIPTION OF THE PREFERRED EMBODIMENTS

Figure 1:
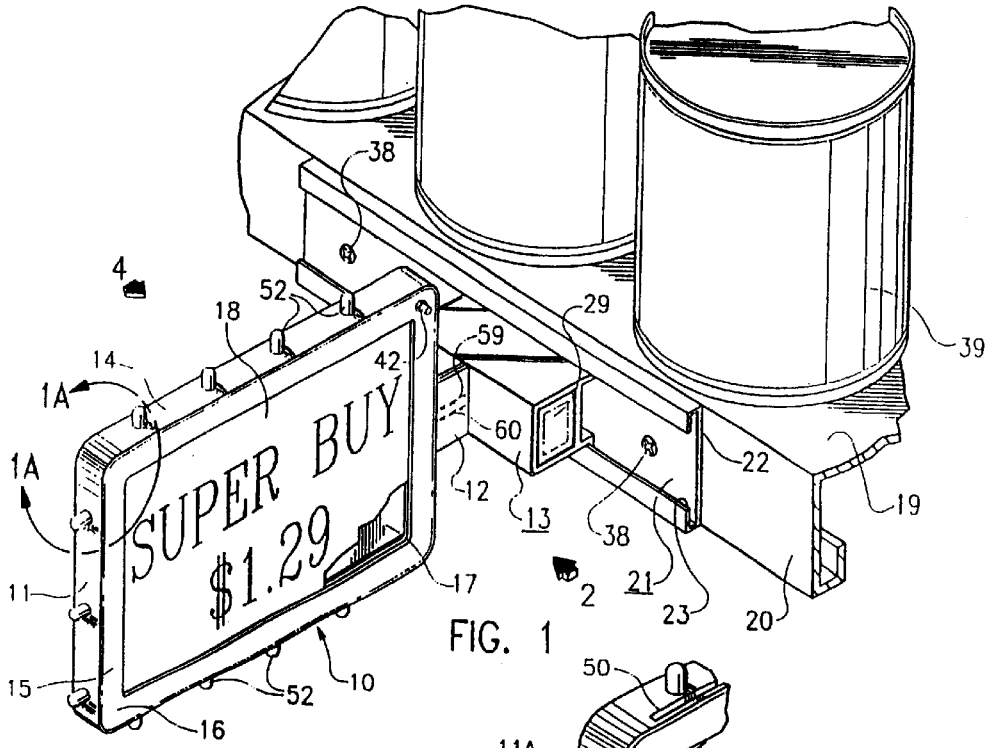
FIG. 1 is a fragmentary perspective view of a shelf incorporating the display device of the present invention.

In FIG. 1 advertising or merchandising display device 10 comprises a panel 11, a resilient flexible tongue 12 integral therewith, and a mounting bracket or clip 13. The panel 11 has a peripheral edge 14 which is contiguous with frame portions 15 at opposite sides of the panel, the frame portions comprising respective peripheral margins 16 at opposite sides of panel 11. Panel 11 includes also a central portion or partition 17, from which tongue or rotor 12 extends, that serves as a backing for a pair of display cards 18, by way of example, which may be contained in respective pockets 19 and 20 in panel 11. Small interior detents as at 20A can be employed to aid in keeping the advertising cards in place. The tab portion or tongue at 12 is designed to be flexible and may be comprised of a coil spring, a resilient, flexible metallic rubber or resilient plastic member, and so forth, this to insure that any jarring of the panel as produced by the impact of a moving cart will not damage the display device but will rather allow it to give, in the direction of motion of the cart, such that when the cart passes, the display device will spring back to its normal, perpendicular condition relative to the shelf edge of the display shelf.

Figure 6:
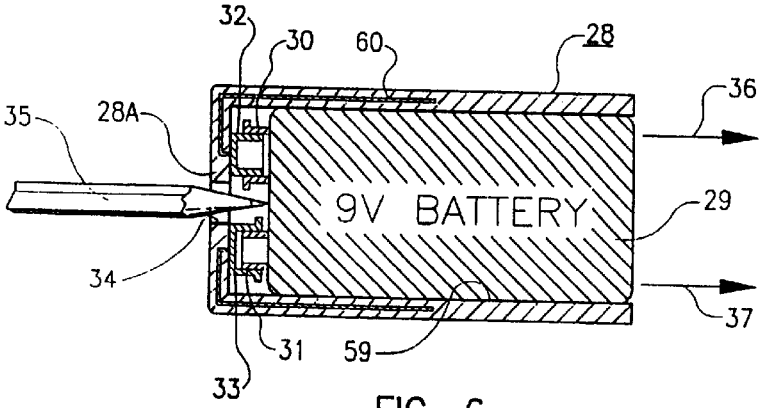
FIG. 6 is an enlarged section detail taken along the lines 6—6 in FIG. 4.

The display shelf 19 is customarily made of metal and has a forward lip 20 which is vertical in orientation. The lip 20 serves as a backing for channel or edge molding 21. The channel 21 includes upper and lower channel slots 22 and 23, each of which receive a respective foot portion 24 and 25 of upper and lower legs 26 and 27. Legs 26 and 27 form integral portions of, and comprise flanges of the composite mounting clip 13. Battery container or stator 28 is secured to tongue or tongue portion 12 by any conventional means and is also made integral, preferably, with mounting clip 13. The battery container 28 is shown in greater detail in FIG. 6 wherein a nine volt battery, by way of example, is included at 29, having its battery terminals 30 and 31 engaging electrical connections 32 and 33, respectively, of the battery housing or container 28. The left end 28A of battery container 28 is closed off excepting for a central aperture 34, designed to receive an implement such as a pencil 35 which can be used to eject the battery 29 from its container 28 in the direction of arrows 36 and 37. A series of screws or rivets 38 can be employed to secure the channel 21 directly to the front lip or portion 20 of the display shelf 19. FIG. 1 thus shows the display shelf as containing a series of cans or other containers at 39, the display device 10 being employed to draw the attention of shoppers to particular specials or other advertising information relative to such goods at 39.

Figure 3:
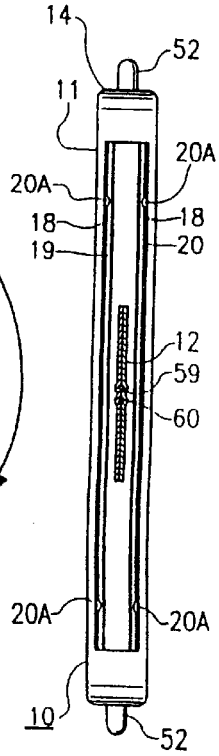
FIG. 3 is a vertical section taken along the line 3—3 in FIG. 2.
Figure 4:
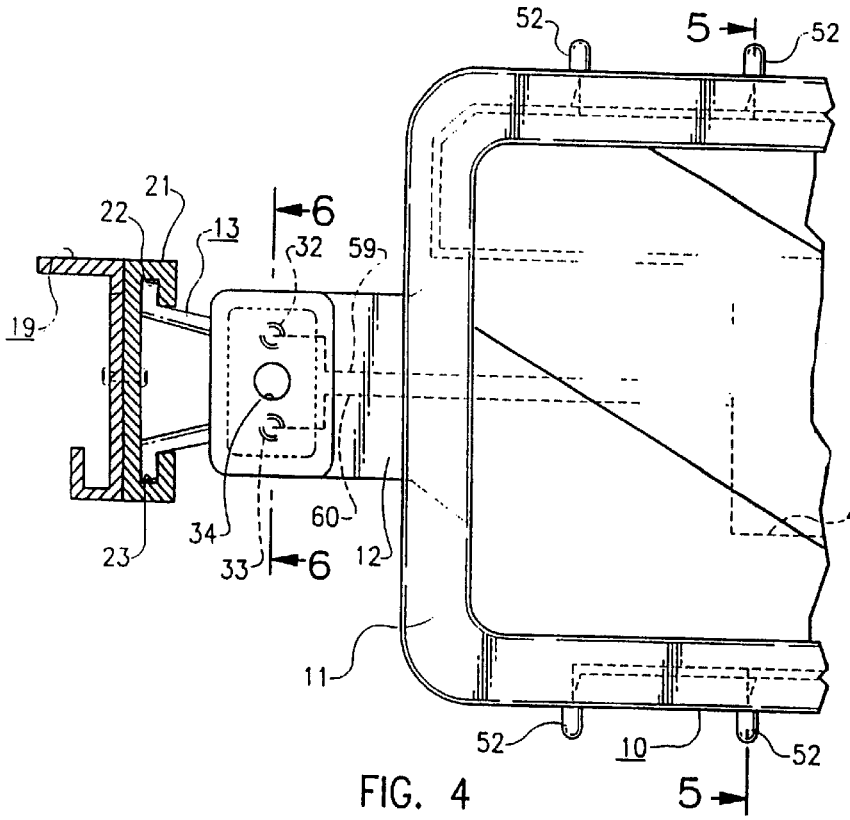
FIG. 4 is an elevation taken along the arrow 4 in FIG. 1.
Figure 5:
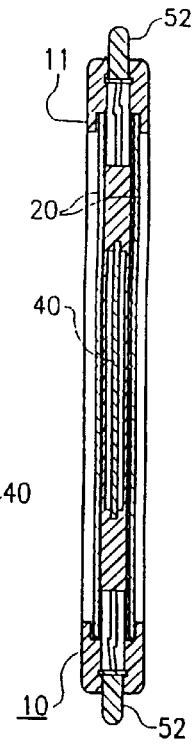
FIG. 5 is a vertical transverse section taken along the line 5—5 in FIG. 4.

Comparison of FIGS. 1 and 4 indicates that different types of signs may be employed concurrently in the respective forward and rear pockets 19 and 20 of the display device, see also FIG. 3.

Figure 7:
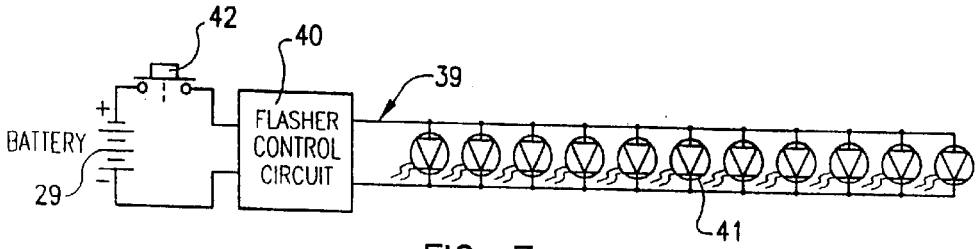
FIG. 7 is a schematic diagram of a representative electrical circuit that can be employed in conjunction with the subject advertising display device.
Figure 8:
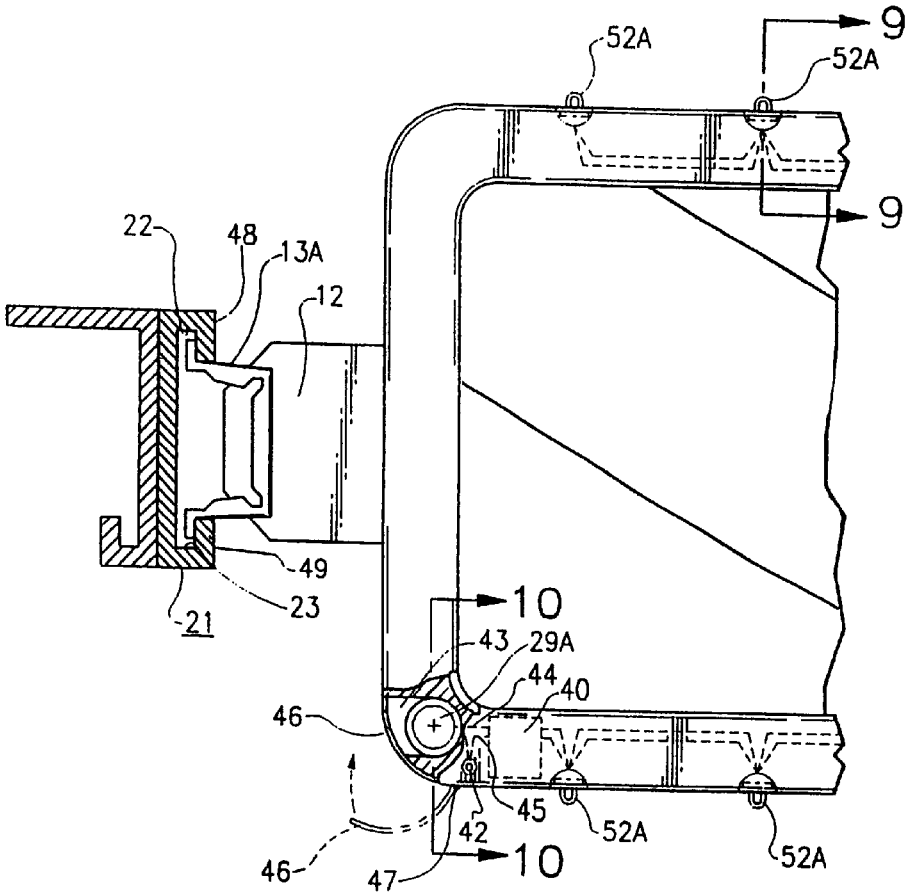
FIG. 8 is similar to FIG. 4 but illustrates this time that the display device can contain in its frame directly the electrical circuit means including its battery.
Figure 10:
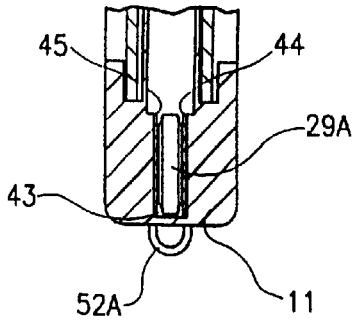
FIG. 10 is an enlarged vertical section taken along the line 10—10 in FIG. 8.

A circuit which may be employed in the display device 10 is shown as circuit 39 in FIG. 7. The same includes battery 29 and, with the same, flasher control circuit 40 as well as a series of lights 41 such as parallel connected LEDs (light emitting diodes). A push button on/off switch 42 is preferably included in the circuit, see FIG. 7 and also FIGS. 1 and 10. An optional way of including the battery in the structure is shown in FIG. 8, wherein a disc-type battery 29A is simply dropped into slot 43, engages electrical connections 44 and 45 leading to the lighting circuit, and wherein the slot 43 is permissibly covered by a cover 46 that is hinged or pivoted at 47 in FIG. 8. The inclusion of the battery at 29A in FIG. 8, corresponding to battery 29 in FIGS. 6 and 7, will this time power the circuit, leaving the mounting clip or stator 13A, corresponding to mounting clip 13 in the other figures, free of battery inclusion; instead the legs and feet may be designed simply to spring outwardly, as is also the case with mounting clip 13, to engage the upper and lower channel portions 48 and 49 of channel 21, see FIGS. 1 and 8. For most type of grocery shelves that are presently used, and which do include, generally, the channel 21, then the upper and lower flanges of the mounting clip 13, comprising upper and lower legs 26 and 27 with their respective feet, will be made resilient such that the legs can be depressed inwardly so that the outer ends of the feet can slip past the upper and lower lips of the channel, this such that these legs can spring outwardly, with the feet engaging slots 22 and 23.

If desired, the clip and the battery container, with an exposed portion of the tongue or rotor 12, may be plastic encased for protection purposes.

Figure 1A:
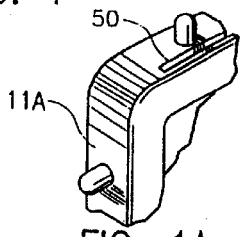
FIG. 1A is an enlarged fragmentary detail of a corner of the display device of FIG. 1 wherein the same contains a single card receiving slot.

FIG. 1A illustrates that panel 11A, corresponding to panel 11 in FIG. 1, may include simply a single slot 50 that can receive a display card 51 containing advertising indicia on both sides, by way of example.

Figure 9:
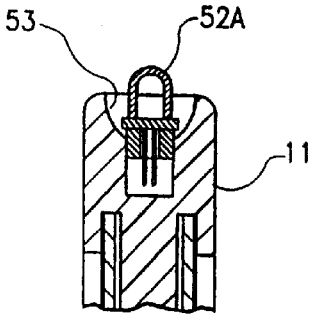
FIG. 9 is an enlarged fragmentary section taken along the line 9—9 in FIG. 8.

The several lights 41, 52 may comprise, again, light emitting diodes or (LEDs), or any other type of light. Included is the concept of employing HID (high intensity discharge) lights which customarily comprise U-shaped tubes having suitable terminal and filled with xenon gas. Other types of gases such as argon, etc., may be employed. Typical xenon HID lights may be employed and are shown at 52A in FIGS. 8 and 9. These, or other lights can include parabolic or other concave reflectors as at 53, which may be either integrally formed with the panel 11 or comprise separate elements tending to concentrate light emissions from the various light elements. The lights themselves are preferably electrically connected together in parallel and, to prolong battery life, and on/off switch as at 42 can be employed. In the structure shown it is preferable that there be two pockets on either side of the central portion of the panel; these pockets contain their respective cards which can be inserted from the tongue or clip side of the device. The tongue, stator or tongue tab-portion 12, is bendable and resilient so that the cards are not exposed to inadvertent vandalism or withdrawal by young shoppers.

Figure 2:
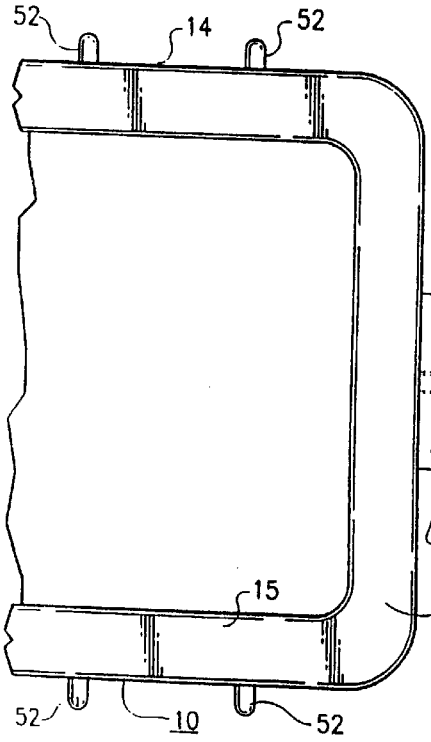
FIG. 2 is an enlarged fragmentary elevation taken along the arrow 2 in FIG. 1.
Figure 2A:
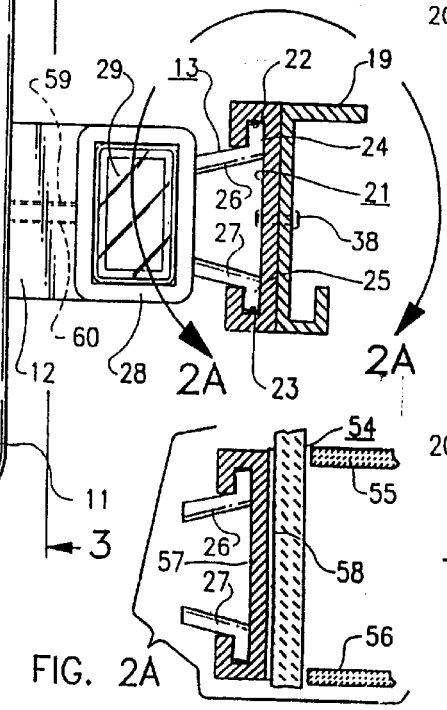
FIG. 2A is a cross-sectional detail taken along the arcuate lines 2A—2A in FIGS. 2 and 11, illustrating that the attachment construction of the display device may be modified so that the same can be adapted for direct attachment to the front panel of the glass door of a display cabinet a fragmentary detail of a portion of which is shown.
Figure 11:
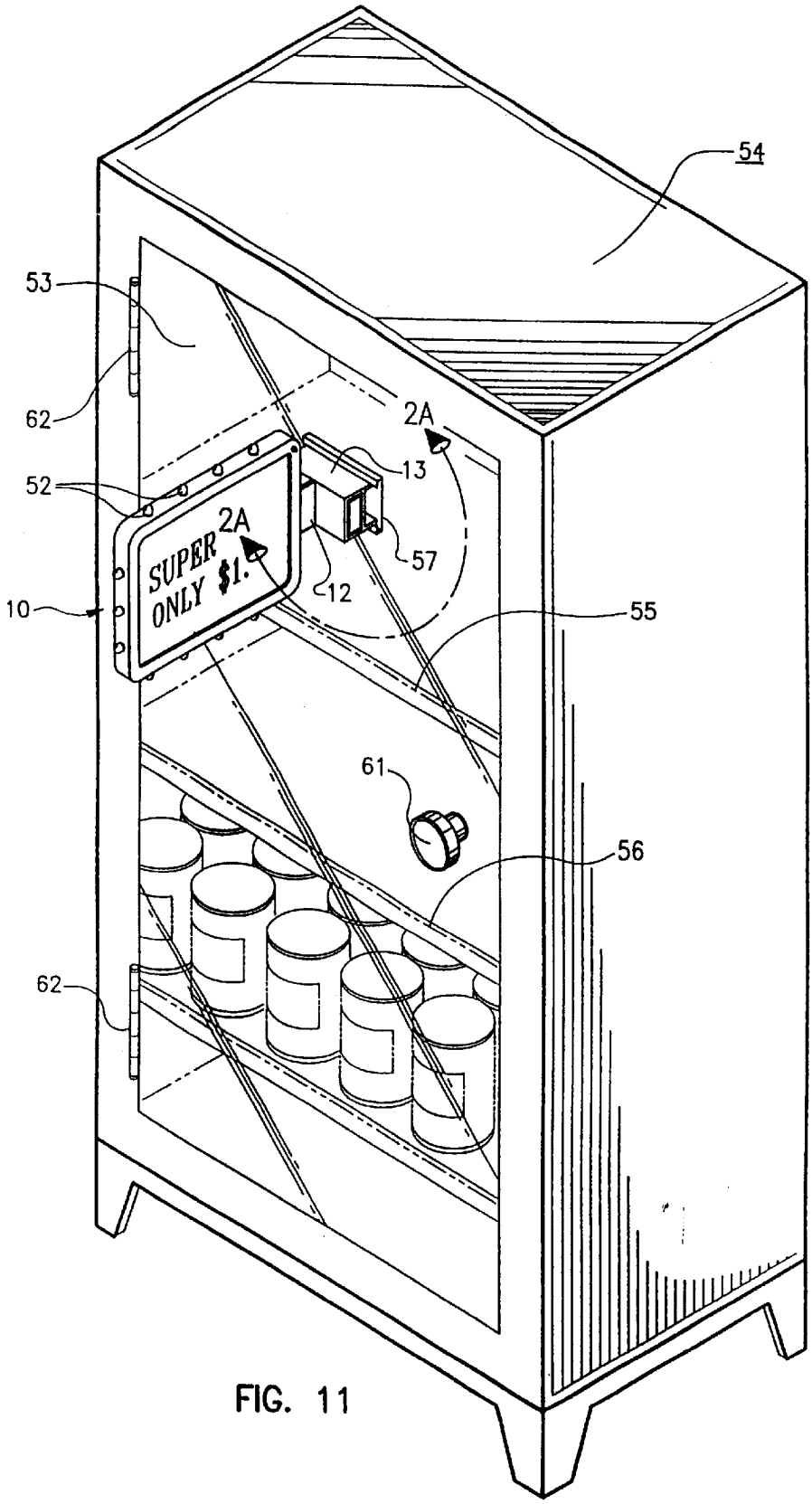
FIG. 11 is a perspective view of a conventional display cabinet, but with the same having the display device of the invention attached to the cabinet's transparent door.

It will of course be understood that the device of the present invention, see the fragmentary cross-sectional view of FIG. 2A, may be used in conjunction with display shelves where the shelves themselves are close to but separated from passersby by means of a glass or plastic door 53 of a refrigerated display cabinet 54. Cabinet 54, see also FIG. 11, thus has door 53 which is provided with door knob 61 and hinge mounts 62 secured to the cabinet proper in a conventional manner. The cabinet may include shelves 55 and 56, and the display device 10 this time includes a plastic or even a metal channel length 57 that can simply be glued or otherwise secured at surface 58, see also FIG. 2A, to the door 53. Accordingly, the display device will highlight the contents of the cabinet, yet the door can be opened in customary fashion so that the shopper achieves easy access to the shelves.

Where the battery and battery container or stator form a portion of or are contained by the mounting clip 13 and the same made integral with tongue, rotor or tab-portion 12, then it is preferred that the electrical wire leads from the battery as at 59 and 60, see FIG. 4, be actually encased in the tongue 12. In this way the wire leads are protected from passersby; yet, their nature permits their flexing with the tab portion or tongue in response to inadvertent movement of display device 10.

Accordingly, what the present invention offers is an at-or-proximate shelf merchandising display device which is illuminated, battery powered, and which serves to draw attention to a variety of store goods. The battery is either self-contained in the panel of the display device or is encased within the clip used to mount the flexible tongue of such device to a forward lip channel associated with a given store shelf.

Rather than, or in addition to plural lights, the subject advertising panel may include battery powered, electrically energized alpha-numeric, liquid crystal or other display indicia, as is conventional with various battery-powered readouts in watches, etc. on the market. Again, the invention is suitable not only for shelves per se, but also for frozen food cabinets, refrigerators, freezers and the like.

In FIG. 12, an advertising display device 63 is shown and includes a frame 64 having outer edge 65 and rear and front rectangular frame margins 66 and 67, these respectively being disposed on opposite sides of the frame. Such margins form opposite windows 68 which display the faces of one or more advertising cards 69. The frame 64 can include an electrical circuit 70, as before, which is coupled to and electrically powers the several display lights 52 and may take the form of electrical circuit board 102 in FIG. 18.

It is noted that the frame 64 includes a slot 71 serving as an admittance slot relative to card insertion of card 69. The interior slot formed by the inner edges of circuit board 102 forms a support receptacle for card 69. The light powering electrical circuit 70 may include electrical leads 59 and 60, see FIG. 1, which pass through a new design of tongue or rotor 72. The latter is formed of a flexible resilient sheath 73 which encases deflection restoring coil spring 74. Spring or rotor 74 is seated at its opposite end turns 75 and 76 to and within recesses 77 and 78 of battery case 79 and frame 64, respectively. Again, the wires 59 and 60 project through the tongue, i.e., through the interior of spring 74 to connect to the electrical circuit 70 powering lights 52. This will be in the same fashion in connection with the electrical circuit shown in the embodiment of FIG. 1, etc. Battery case or rotor 79 may include an end aperture 80 for receiving a battery push-out tool such as pencil 35 in FIG. 6. Optional to this of course may be included a battery rejection spring within battery case 79 for enabling a battery retrieval. The inner circuit 81 of battery case or holder 79 includes a pair of conductor strips 82 and 83 which are electrically connected to leads 59 and 60. Conductive strip 82 leads to battery end contact 84 which is secured at 85 to the battery case in a manner conventional with battery case constructions. Conductive strip 83 is connected to a conductive threaded ring 86 at the remaining end of the battery, and a plug or cap 87 is provided with a contact 88 and a conductive strip 89 leading to matching conductive threaded ring 90. Accordingly, insertion of batteries 91 and 92 within the cavity 93 of the battery case, and the securement of the cap 87, produces an electrical contact circuit and hence an electrical energy supply circuit, via the battery and its conductive strips to electrical circuit leads 59 and 60.

Mounting clip 93 can be designed similarly to clip 13 in FIG. 2 and, in any event, will be secured by attachments 94 to battery case 79. The clip may be designed to be resilient, whereby the up-turned ends thereof 95 and 96 will be releasably and selectively received into the upper and lower recesses of channel molding 97 that corresponds to molding 21 in FIG. 1. Molding 97 of course will be secured in the usual manner to shelf 98 of any description which corresponds to shelf 19 in FIG. 1. In the preferred form of the invention, the mounting clip 93 will be locked in place relative to the channel molding. This will be accomplished by the locking structure shown in FIG. 14 whereby the securement of the mounting clip relative to the channel molding is made permanent or is of a semi-permanent character. The securement of the channel molding 97 to the outer-shelf edge may be effected by attachment 99.

Accordingly, FIGS. 12, 12A, 12B and 13 illustrate the incorporation of a horizontal battery case with contained batteries with the same being supplied an electrical circuit leading through a tongue or extension such as, this time, a coiled deflection-restoring spring 74, to the electrical circuit of the frame 64 of advertising display device 63. What is accomplished, therefore, is the provision of a battery pack, i.e., case and batteries, which is separate from the frame proper, but constructed for selected mounting to a shelf molding. More importantly, the leads powered by the batteries in the case project through the tongue, i.e., this time through the spring 74 and its protective sheath, to connect to the electrical circuit of the device. An on-off switch may be provided for the electrical circuit if desired, and in accordance with the teaching of the prior figures.

Figure 18:
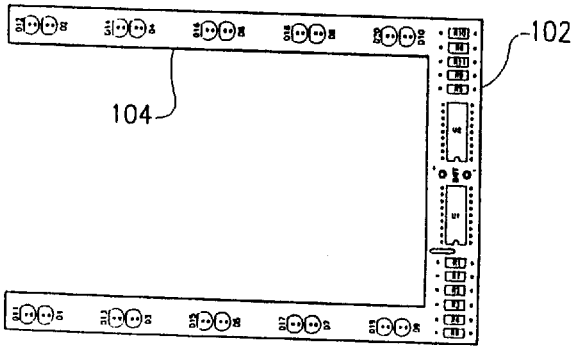
FIG. 18 is a top plan of a circuit board which may be used in the frame of the device to power its lights.
Figure 15:
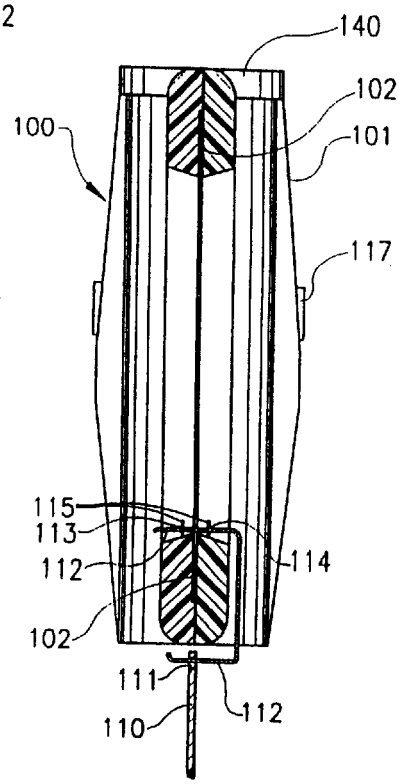
FIG. 15 is a vertical transverse section taken along the line 15—15 in FIG. 14.
Figure 19:
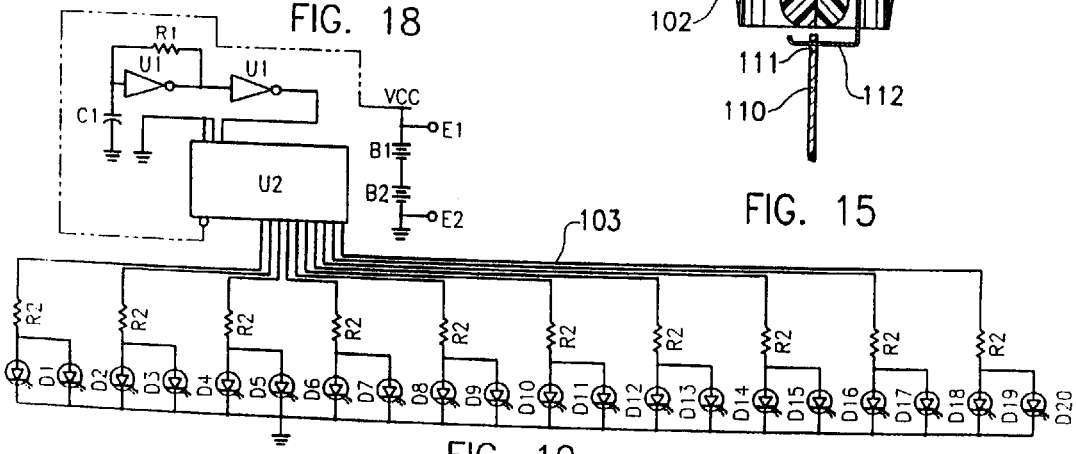
FIG. 19 is a schematic of one of several electrical circuits which can be used in powering the lights of the advertising display sign.

FIGS. 14, 14A, 15, 16, and 16A, with FIGS. 18 and 19 constitute another embodiment of the invention. However, other than being U-shaped to accommodate insertion and support for card insertion in the frame, the circuit board of FIG. 18 and its representative circuit as shown in schematic form in FIG. 19 are strictly conventional and may take any one of a number of forms, familiar to all skilled in the art. Representations as inverters U1 and counter U2. VCC (voltage common cathode) connection is had at the customary points for the circuit components. LED light positioning, D1–D20, for lights 52, is also illustrated. Standard resistors are utilized at R1, R2 as well as capacitor C1, all selected in accordance with conventional established design procedures. The particular circuit design selected for the circuit board forms no part of the invention.

Figure 14:
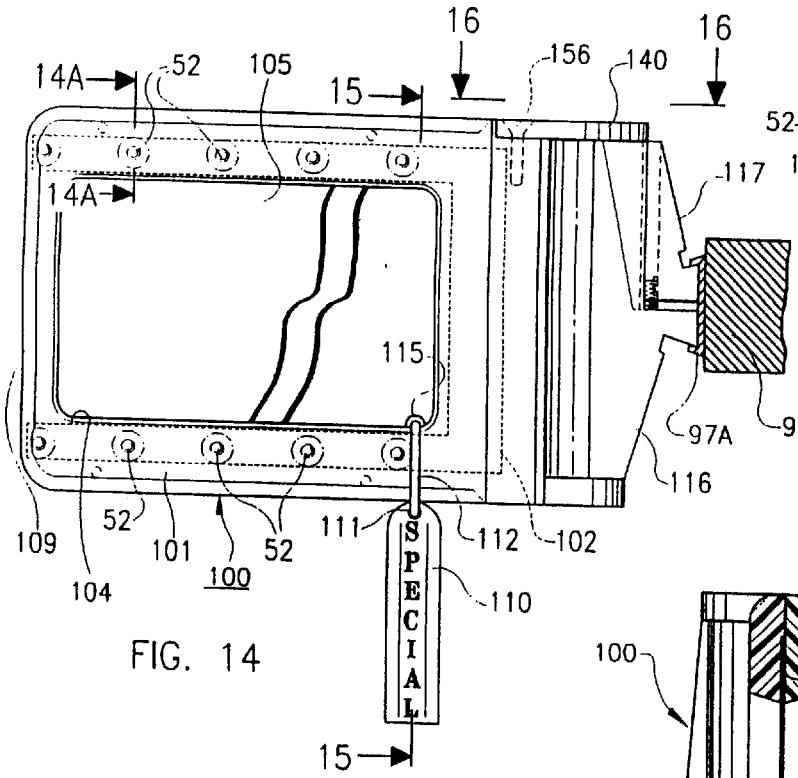
FIG. 14 is a side elevation of another embodiment of the invention.
Figure 14A:
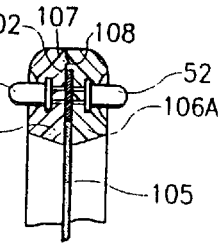
FIG. 14A is an enlarged fragmentary cross-section taken along the line 14A—14A in FIG. 14.
Figure 17:
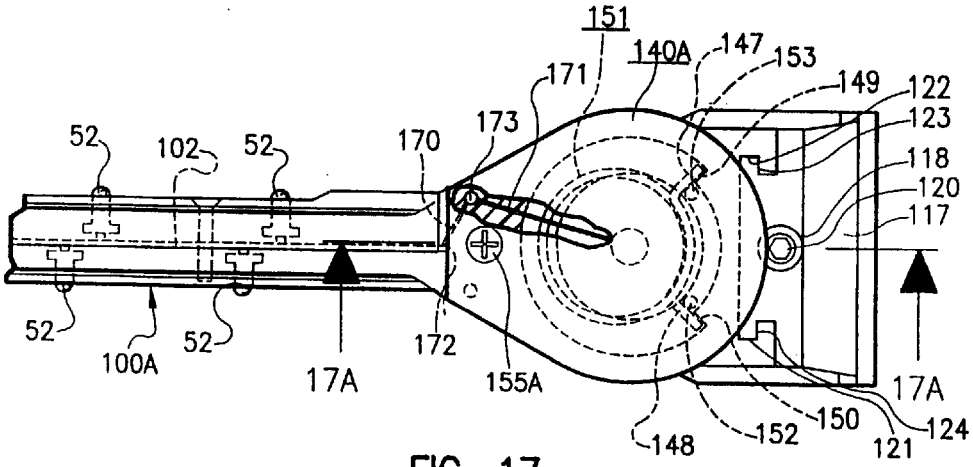
FIGS. 17 and 17A are essentially identical to FIGS. 16 and 16A, respectively, but illustrate a re-arrangement of conductive leads to accommodate single, centralized, screw-attachment placement.
Figure 17A:
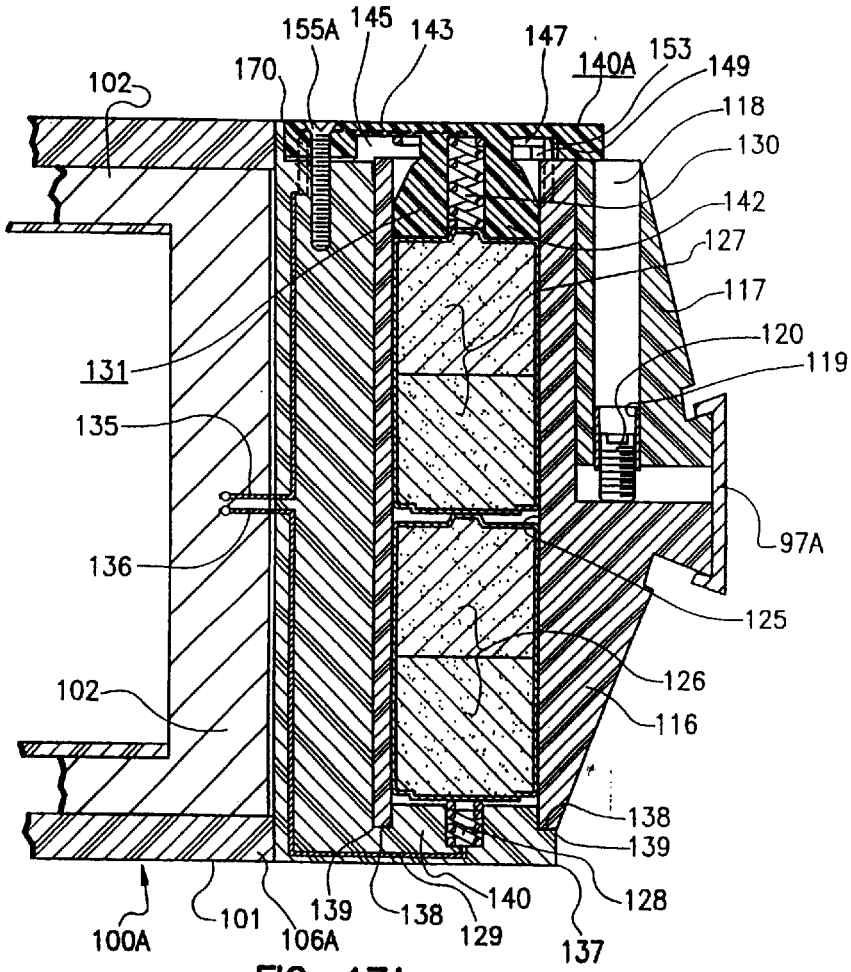

FIGS. 17 and 17A illustrate yet another embodiment of the advertising display device that is closely similar to that shown in FIG. 14, e.g., but illustrates certain minor modifications.

In FIG. 14 the advertising display device 100 is shown to include a frame 101 that is interiorly provided with a circuit board 102, having conventional elements as seen in circuit 103 in FIG. 19, but which will be encased within the frame to supply electrical power therefore to the several lights 52 and, additionally, provide a slot 104 for the reception of advertising card 105. Where desired, the frame 101 may be constituted by separate halves 106 and 106A which can be secured together by male, female connectors 107, 108, by screws, or by other means. Frame half 106A can be integral with body 137. Card 105 is designed to slip into end slot 109 which can be similar to slot 71 in FIG. 12B. A tag 110 may be one of several provided, the same incorporating an aperture 111 which receives a hook-shaped pin 112. This pin proceeds through apertures 113 and 114 of ears 115, protruding outwardly on both sides of the frame. Accordingly, pin 112 is operative not only to support "special" or other tags, for promotional purposes, but also releasably secures the card 105 within the frame of the advertising display device. The shelf 98 in FIG. 14 is provided with channel edge molding 97A, corresponding to channel molding 97 in FIG. 12.

Figure 16:
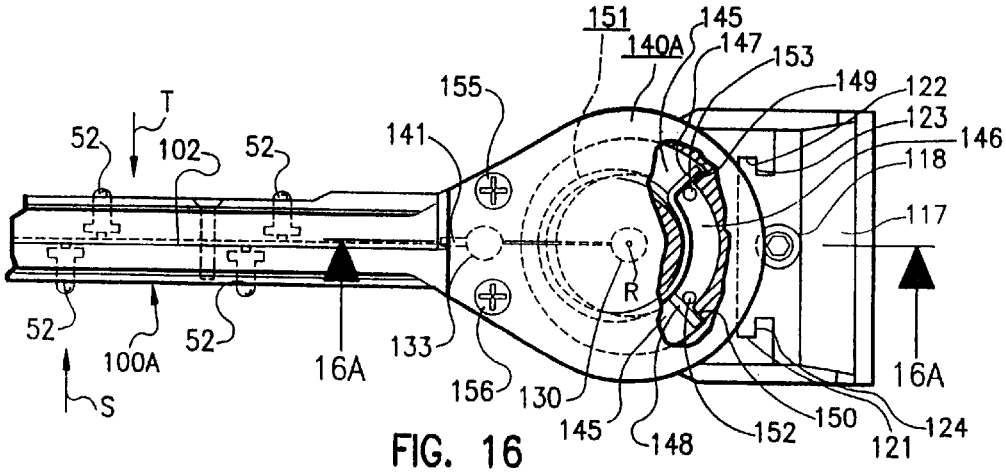
FIG. 16 is an enlarged fragmentary top plan taken along the line 16—16 in FIG. 14.
Figure 16A:
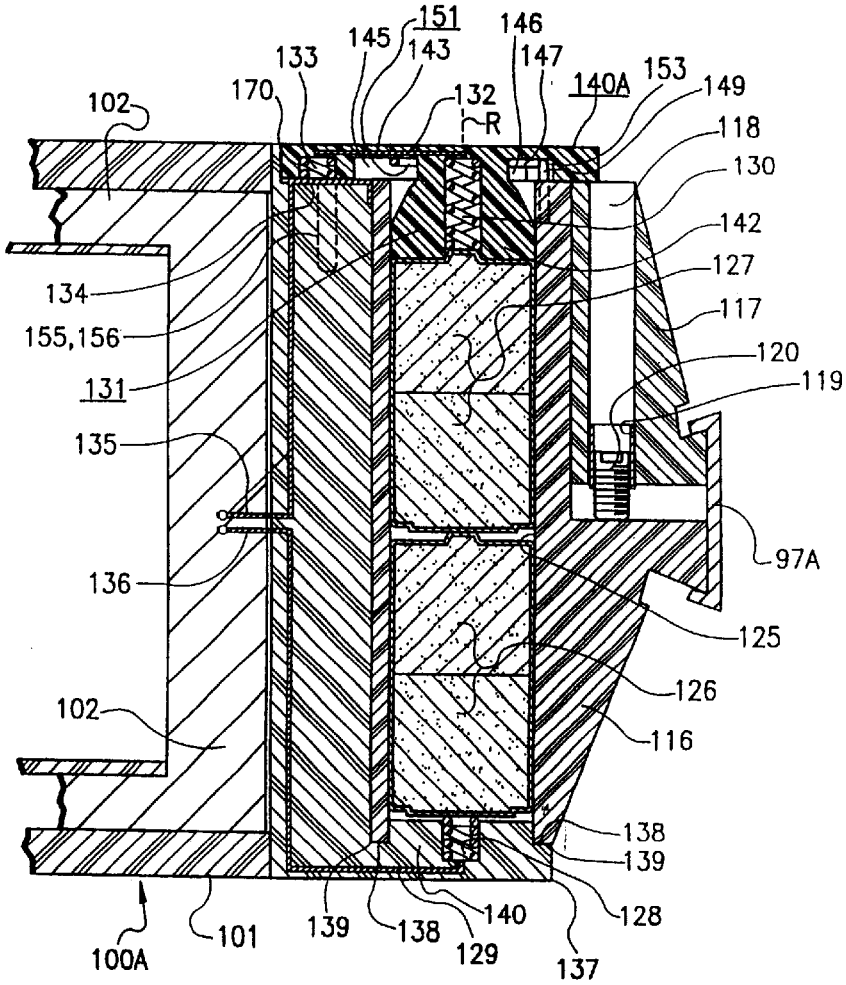
FIG. 16A is a longitudinal vertical section taken along the line 16A—16A in FIG. 16.

FIGS. 16 and 16A illustrate that the embodiment introduced by FIG. 14 includes a fixed securement member or stator 116 and also a sliding securement member 117. The sliding securement member 117 includes a central aperture 118 having a threaded metal insert 119 that receives adjustment screw 120. Access to adjustment screw 120 is had through the bore or aperture 118 by an elongated screw driver, Allen wrench fitting or the like. Channel edge molding 97A is also seen. Thus, as to member 119, the same provides a locking mechanism for locking the entire display device 100 in position by simply tightening down on the screw 120, which is recessed to be tamper-proof. Member 117 may be configured as shown in FIG. 16 with outer ribs 121, 122. Therefore, the sliding securement member is retained in slide disposition by the undercut slots or grooves 123 and 124 as the same is adjusted up and down by screw 120. FIG. 16A illustrates that the fixed securement member 116 includes an interior circular cavity 125 which receives serially connected batteries 126 and 127. A battery spring 128 serves to retain the batteries together and also provides electrical contact to conductive strip 129 which leads to lead 136 of the electrical circuit powering lights 52. Correspondingly, battery spring 130 is supplied to the cap member 131 and connects to conductive strip 132 which leads to spring 133. Spring 133 in turn is connected to conductor strip 134 connected to lead 135 which is associated with the electrical lighting circuit of the display sign. Thus, the ground and VCC (power) lines, see FIG. 19, will be coupled to the electricity supply leads 135 and 136.

Body 137 forms an extension of and moves with frame 101 and includes a recessed seat 138 which accommodates the bearing engagement of end 139 of member 116. The raised boss 140 is recessed to provide for the battery spring 128. Accordingly, and relative to the engagement of fixed securement member or stator 116 with body 137, it is seen that the latter can be rotationally displaced about pivot access R in accordance with temporary deflections of the frame as occasioned by inadvertent impact by passengers or carts in the direction of arrows S and T in FIG. 16. More will be said about this in conjunction with the return torsion spring feature of the invention at a later point.

At this point it is important to note the cap member 140A and its provision with electrical current conducting battery spring 130 in the latter engagement with batteries 126 and 127. Cap member 140A likewise includes the spring 133 as previously mentioned which provides for electrical connection between conductive strip 132 and strip 134 coupled to lead 135. The depending portion 142 of cap member 140A is illustrated and additionally serves to hold down and hold in place the batteries 126 and 127. Importantly, see FIG. 16, the upper portion 143 of cap member 140A includes a circularly arcuate enlarged major recess 145 and, contiguous therewith, the arcuate minor recess 146. These are seen in both FIGS. 16 and 16A. The arcuate major recess or travel path 145 accommodates the movement of the outwardly turned extremities 147 and 148 of circular torsion spring 151 as the sign is laterally deflected according to forces S and T in FIG. 16. Shoulder stop 149 and shoulder stop 150 respectively retain the remaining end of the torsion spring 151. Upstanding pins 152 and 153 co-act with the torsion spring and are upstanding from fixed securement member or stator 116. Screws 155 and 156 are provided in FIG. 16 to retain the cap member 140A in position. Thus, these screws will be threaded into apertures, not shown, positioned in body 137.

The remainder of the operation of the embodiments shown in FIGS. 14, 16 and 16A is as follows: The batteries 126 and 127 with their electrical circuit elements, comprising springs 128 and 130 and conductive strips before mentioned leading to leads 135 and 136, supply power to the circuit board in the frame of the display device. The apparatus is assembled as heretofore indicated, with cap member 140A finally being positioned in place and fixed to the frame and screws 155 and 156 tightened.

In referring to FIG. 16, an inadvertent and temporary deflection in the direction of, e.g., arrow S will produce a clockwise rotation of the sign about axis R. This is simultaneously accompanied by a rotational displacement of cap member 140A, and hence of its shoulder stops 149 and 150. The upstanding pins 152 and 153, upstanding from fixed securement member 116, are stationary, however, relative to the shelf edge molding, so that there will be a temporary torsional tightening of the spring by one of the pins 152, 153, depending upon the direction of frame displacement and thus producing a potential restoring force in the spring. Once temporary pressure is relieved relative to arrows S and/or T, then the spring will operate against its associated pin 152, 153 to restore the sign to orthogonal relationship relative to the shelf. It is important to note that the pivoting functioning is accomplished proximate the battery case enclosure and that the unit may be clamped to the molding strip, remain stationary, and yet provide for the flexibility and circuit connection needed for the sign proximate the battery enclosure. The display device 100A in FIGS. 17 and 17A is essentially identical with that shown at 100 in FIGS. 14, 16 and 16A, but with the following exceptions. A single screw 155A is employed to secure cap member 140A, corresponding to cap 140 in FIG. 16A, to the body 137 of the unit. Conductive strips 170 and 171 this time are secured to the spring 130, see FIG. 16A, and are angulated in dog-leg configuration to connect at 172 to the electrical circuit of the sign. In this manner but a single screw can be used at 155, can be centered, and the electrical circuit required, with its connections, still be supplied. Metal conductive pin 173 may be employed at the point indicated in FIG. 17A to complete the circuit.

Hence, what is provided in this invention are a plurality of embodiments of advertising display signs having sufficient flexibility to allow for a restoring force and yet temporary relief for inadvertent forces acting on the sign. Furthermore, the several embodiments illustrate that the display sign can be releasably or securely engaged with the molding strip of a store shelf, and a battery case supplied at the mount for powering the sign. In a preferred form of the invention the battery case itself incorporates structure whereby to facilitate a pivotal displacement of the sign as may be occasioned.

At all events, the electrical circuit requirement is met for the displacement sign, whether a spring, a resilient member, or other structure is employed.

Figure 20:
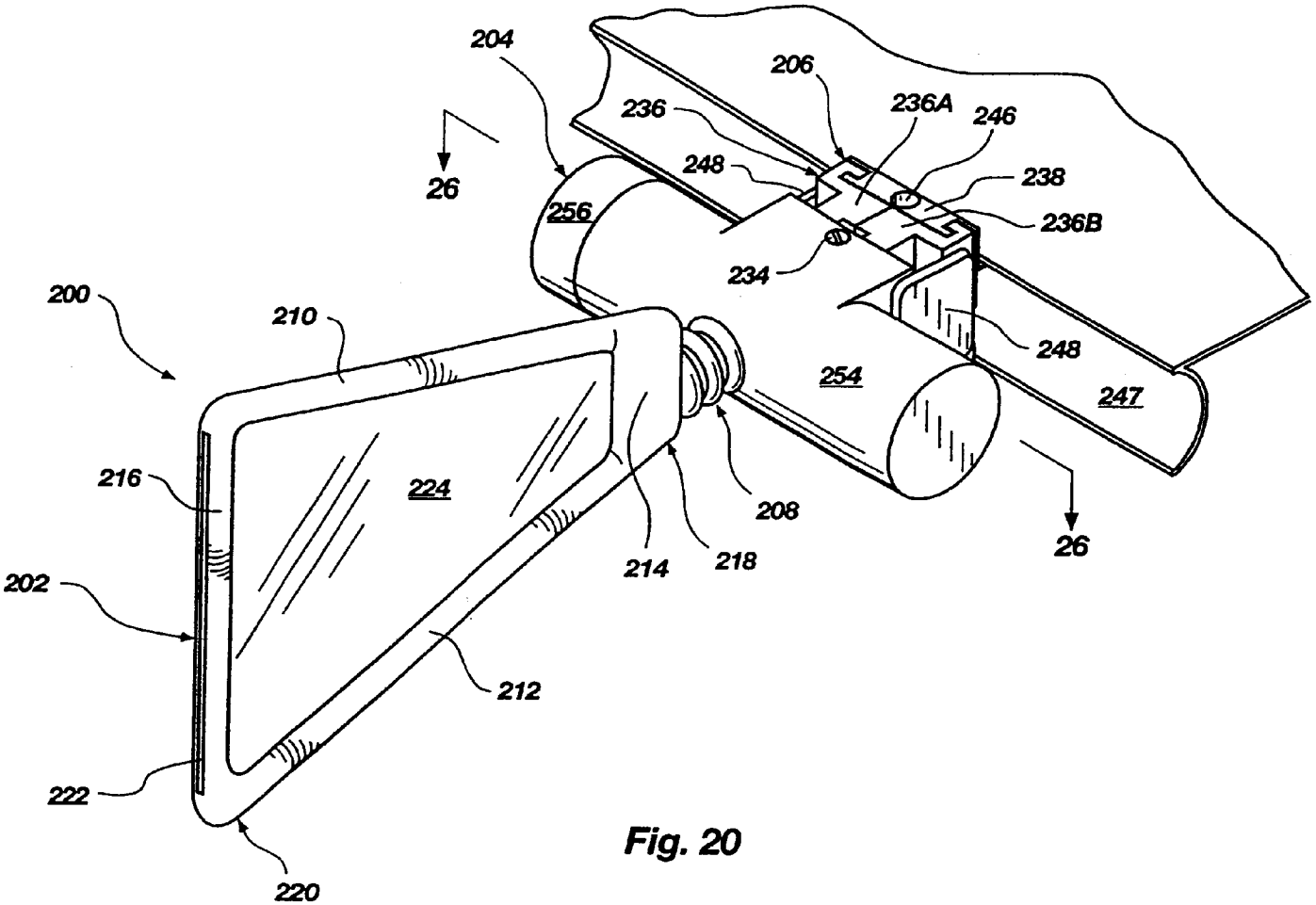
FIG. 20 is an isometric view of an alternative embodiment of a sign display apparatus according to the present invention.

FIG. 20 shows a particular alternative embodiment of the present invention. Specifically, a sign display 200 for point-of-purchase advertising is shown. The sign display generally includes a frame portion 202, a power supply housing 204, and an attachment bracket assembly 206. A yieldable, resilient flexion joint or rotor 208 couples the frame portion 202 with the combined power supply housing or stator 204 and attachment bracket assembly 206.

The frame portion 202 is best described with reference to FIGS. 20, 23, and 25. The frame portion 202 includes a top frame member 210, a bottom frame member 212, a proximal frame member 214, and a distal frame member 216. In one embodiment, the frame portion 202 is generally configured such that the proximal frame member 214 defines a relatively small proximal sign segment 218 and the distal frame member 216 defines a relatively large distal sign segment 220. The relatively small sign segment 218 provides for substantially unrestricted access to shelf areas above and below the sign display, while the relatively large distal sign segment 220 provides ample sign surface area for effective point-of-purchase advertising.

The distal frame member 216 further defines a slot 222 for inserting advertising materials 224, such as a rigid paperboard or the like, into operative position within the sign display 200. The slot 222 is sized to accommodate the largest vertical dimension of the advertising material 224. It should be understood that the advertising material 224 may comprise a substantially opaque material such as paperboard, cardboard, paper, or like material. Alternatively, the advertising material 224 may comprise a partially transparent material (e.g., polycarbonate or glass) with specific advertising indicia affixed thereon. As yet another alternative, the advertising material 224 may comprise a series of sheets, such as a pair of transparent sheets of material (e.g., glass or polycarbonate) and an opaque sheet of material positioned in between. Still another alternative embodiment may include a substantially transparent material (e.g., glass or plastic) with indicia provided on at least one surface of the transparent material.

Figure 21:
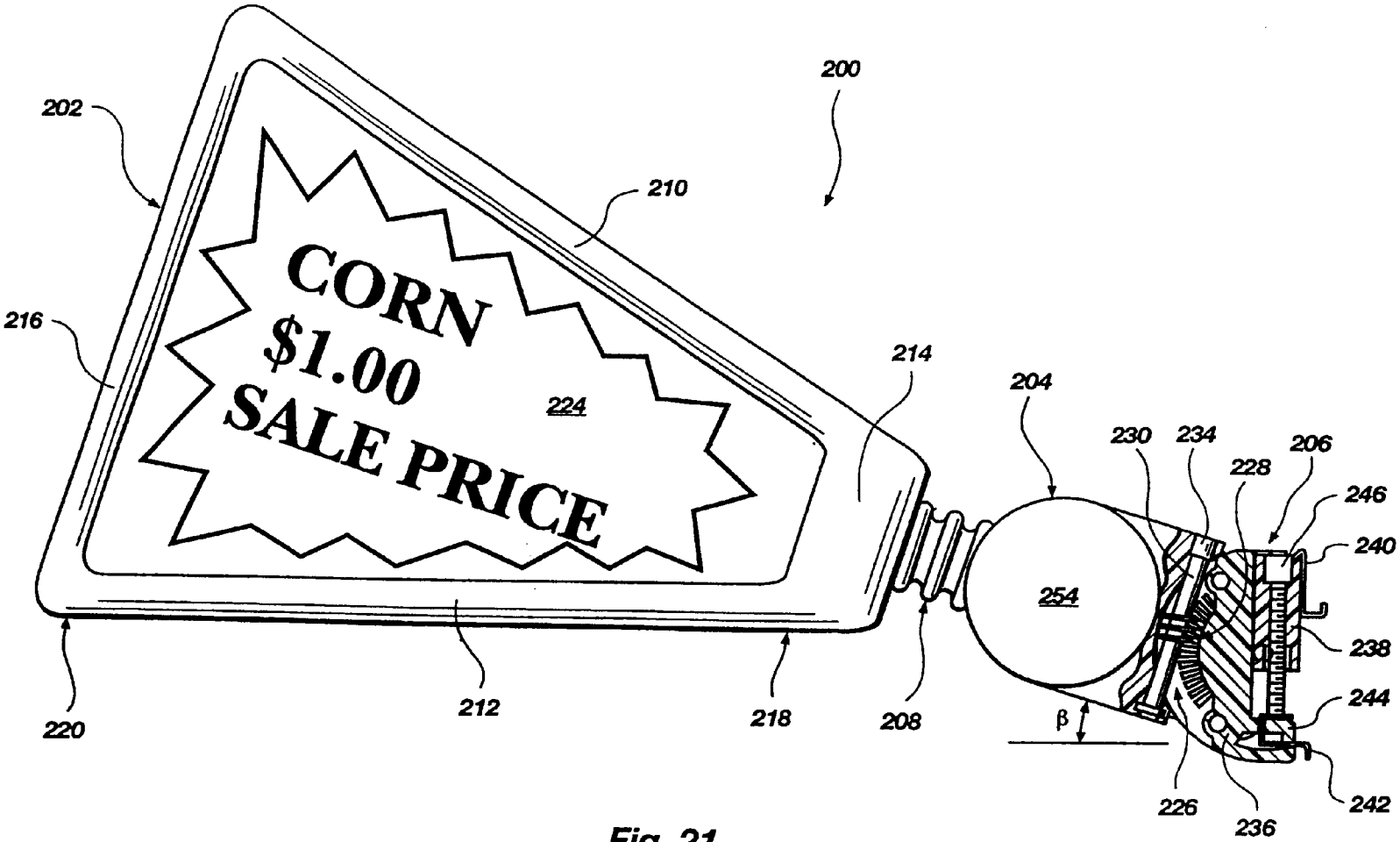
FIG. 21 is a right side elevation view, partly in section, of the sign display apparatus of FIG. 20.

In the embodiment shown in FIGS. 20–23, the shape of the advertising material 224 is substantially pie-shaped or triangularly shaped with a relatively short vertical dimension provided adjacent the small proximal segment 218 and a relatively tall vertical dimension corresponding with the large distal segment 220 of the sign display 200. Indicia provided on the advertising material 224 may require that the orientation of the sign be adjusted to a particular presentation angle β (FIG. 21). To adjust the presentation angle β, the attachment bracket assembly 206 includes a worm gear assembly 226 (FIGS. 23–24) specifically comprising a stationary gear 228 having a plurality of teeth and a rotating adjustment screw 230 having a plurality of threads 232. The threads 232 rotate through the teeth of the stationary gear 228 to move the frame portion 202 through a plurality of presentation angles until the desired angle β is achieved. The rotatable adjustment screw 230 includes a head 234 into which an adjustment device, such as a straight-slot screwdriver, can be inserted to adjust the presentation angle.

The presentation angle is preferably set to orient the advertising material in a manner that will be easy for a purchaser to read.

Figure 22:
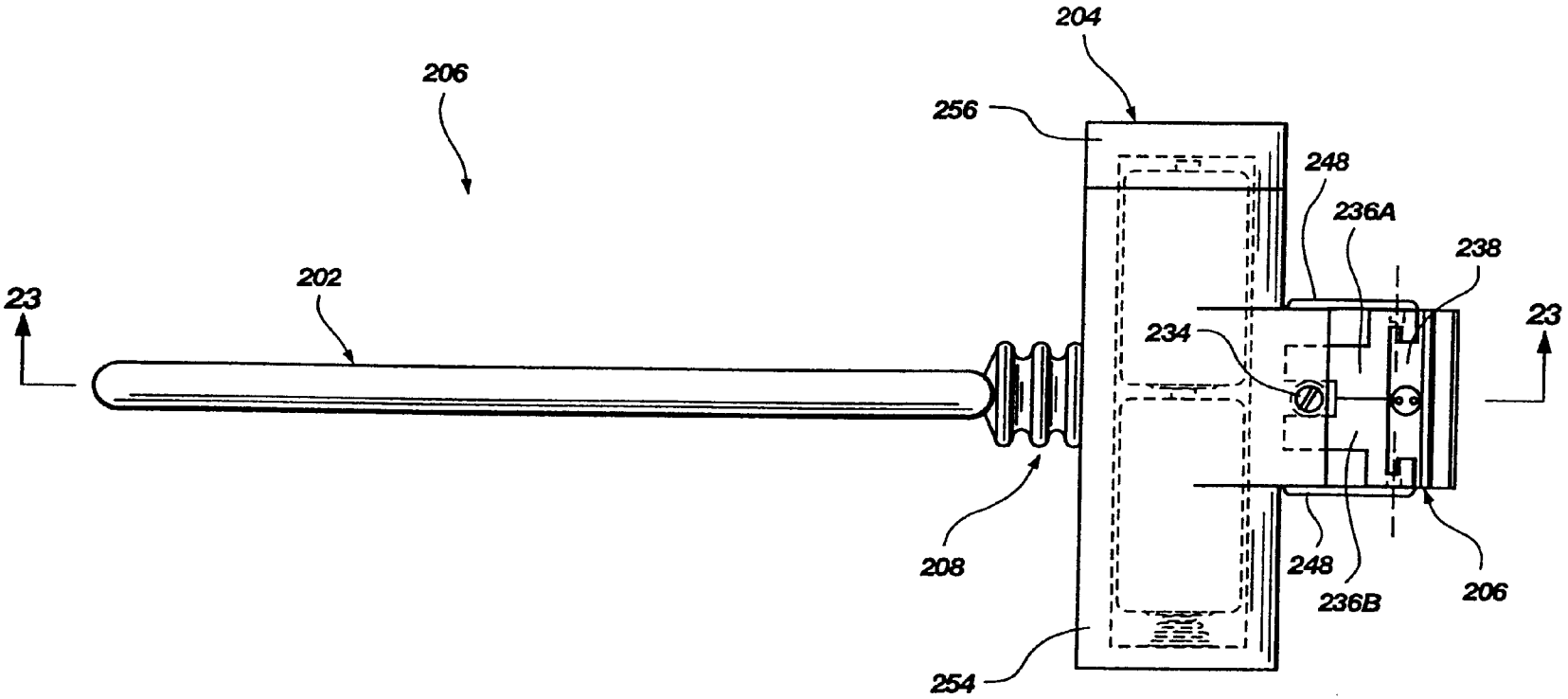
FIG. 22 is a top view of the sign display apparatus of FIG. 20.
Figure 24:
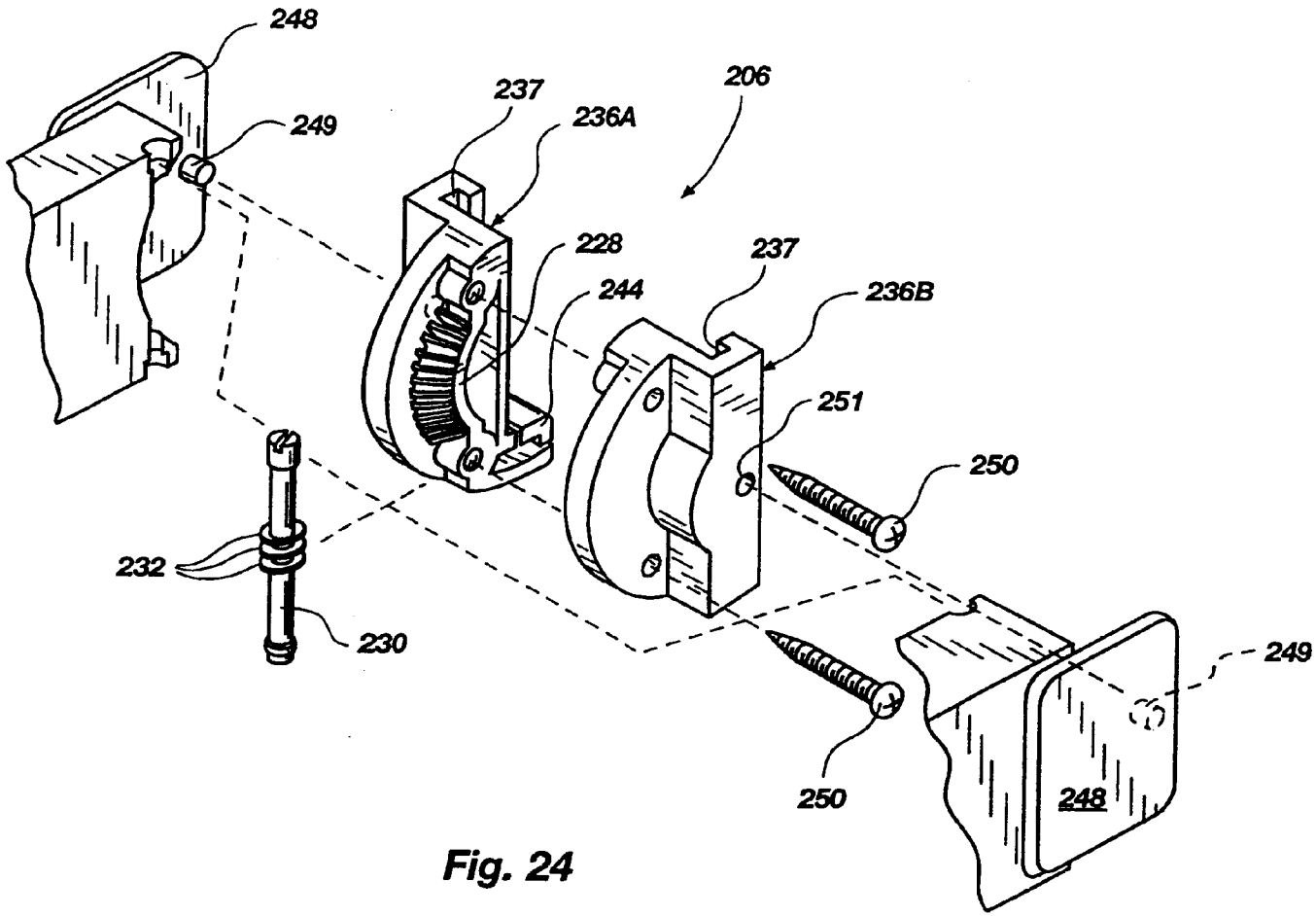
FIG. 24 is an exploded isometric view of the mounting bracket portion of the sign display apparatus of FIG. 20.

The attachment bracket assembly 206 still further comprises a mounting base 236, formed by two mirror halves 236A and 236B. A sliding block 238 is slidably mounted between the halves 236A and 236B. An upper clip 240 is mounted to the sliding block 238. A lower clip 242 is mounted to the base 236 so as to be inserted through slots created by a tongue member 244 (FIG. 24). A rotatable adjustment screw 246 is disposed between the tongue member 244 and the sliding block 238. Rotation of the screw 246 moves the sliding block 238 relative to the base 236 to adjust the spacial relationship of upper clip 240 and lower clip 242 for securing or releasing the sign display from a shelf or other advertising area. As the sliding block 238 moves away from tongue member 244, the upper clip 240 and lower clip 242 lock into an attachment bracket associated with the shelf or other display structure. As shown in FIGS. 20, 22, and 24, a pair of sidewalls 248 are mounted to the base members 236A and 236B to prevent lateral displacement of the power supply housing 204 relative to the attachment assembly 206. The first base member 236A is secured to the second base member 236B by means of conventional fasteners 250. The sidewalls 248 include male posts 249 inserted into corresponding apertures 251 (only one shown in FIG. 24) in the base 236. The posts allow articulation of the frame portion 202 relative to the mounting base portion 206 upon movement of the adjustment screw 230.

Figure 23:
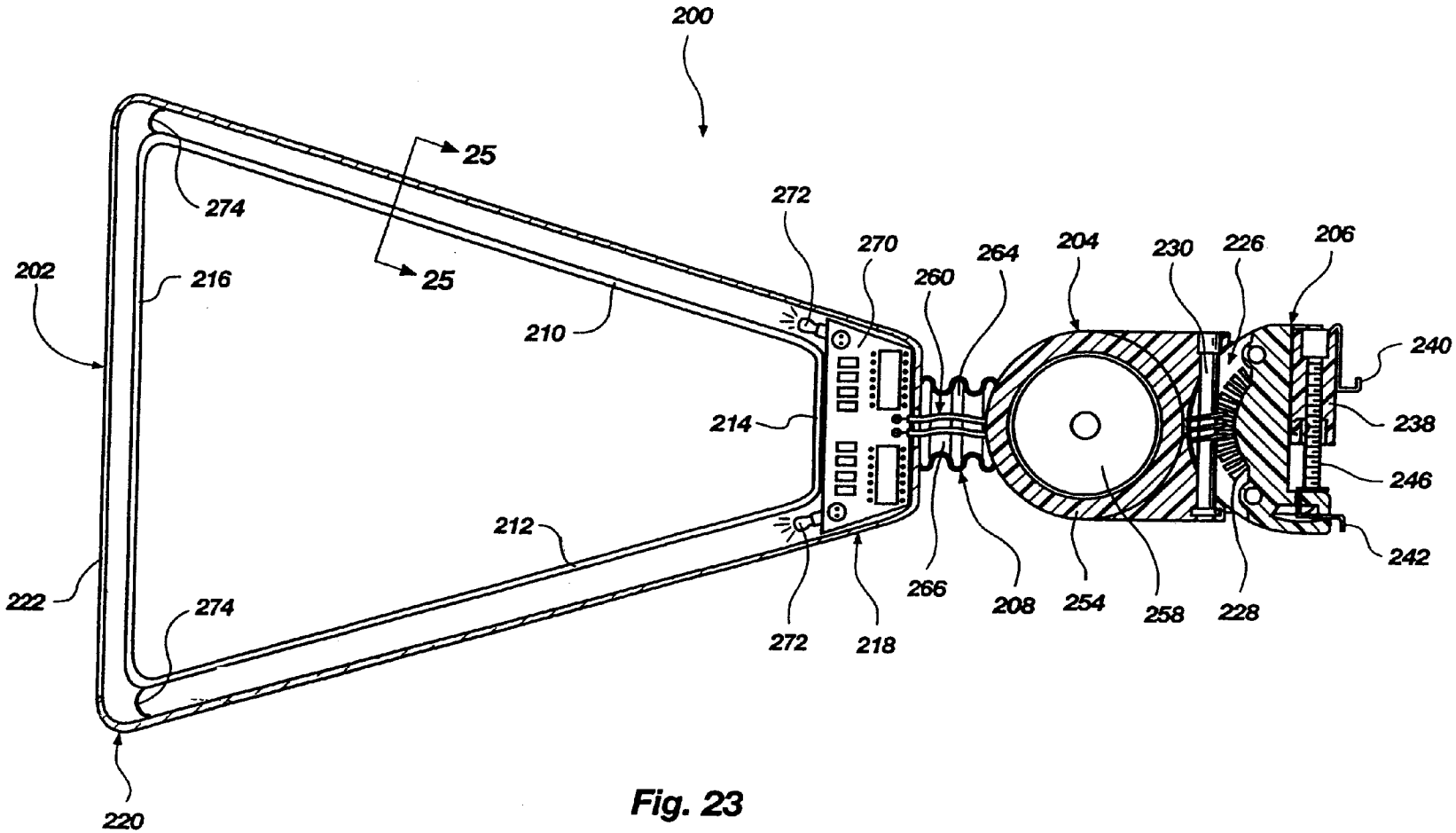
FIG. 23 is a sectional side elevation view, taken along the line 23—23, of FIG. 22.
Figure 26:
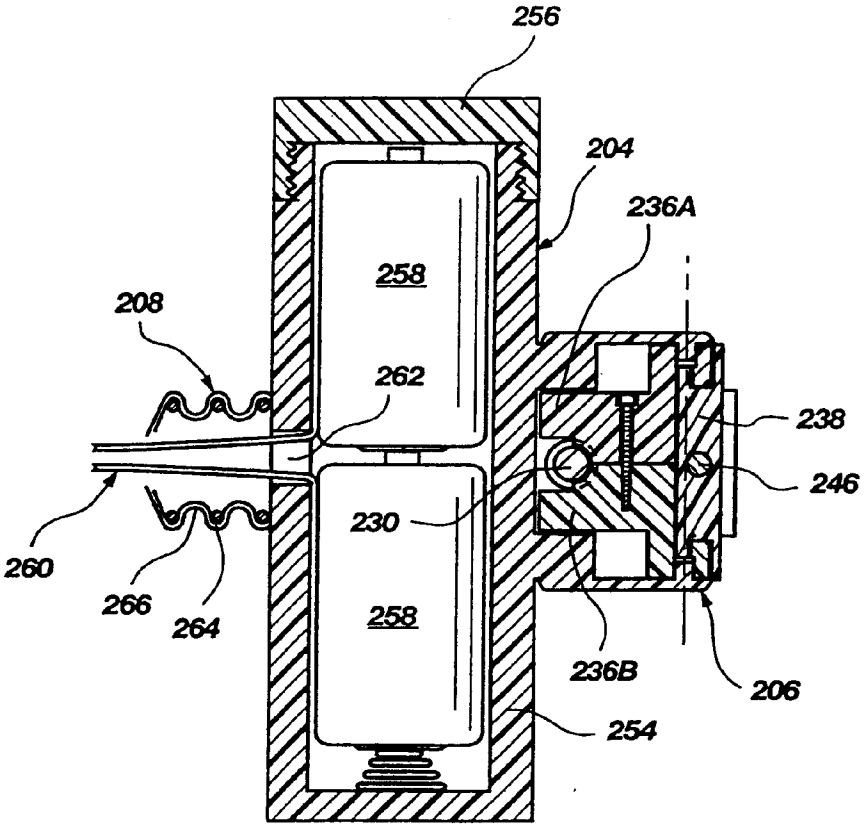
FIG. 26 is a sectional top view of the power source housing and attachment bracket, taken along the line 26—26 of FIG. 20.

With reference to FIGS. 22, 23, and 26, the power supply housing 204 comprises a main compartment structure 254 and an end cap 256 threadedly received by the main housing structure 254. Conventional batteries 258 are held within the power supply housing 204. Lead wires 260 extend from the power supply housing through an opening 262 formed in the main housing structure 254. The lead wires supply power to the light display associated with the frame section 202. The lead wires are protected by a yieldable, resilient flexion joint 208. As shown in FIG. 26, the flexion joint more specifically comprises a resilient spring-bias member 264 surrounded by a rubber boot 266. The boot 266 allows the resilient bias member 264 to yield and bend while protecting the lead wires 260. Mounted within the proximal section 218 is the circuitry 270 used in illuminating the frame section 202. The circuitry 270 may comprise any conventional circuitry to illuminate light sources 272. The circuitry may provide differentiating illumination for the light sources 272, alternating the supply of power to the light sources 272, or any other desired result. The light sources 272 are provided to direct light through the upper frame section 210 and the lower frame section 212. A pair of parabolic mirrors 274 are mounted within the upper and lower frame sections 210, 212, respectively, to provide enhanced illumination within the tubular areas. The frame sections 210, 212 are preferably made of a translucent material so that light is emitted to catch the attention of shoppers. A benefit of the present invention is that with the illumination as proposed, only two light sources are required to fully illuminate the top and bottom frame sections 210, 212.

Figure 25:
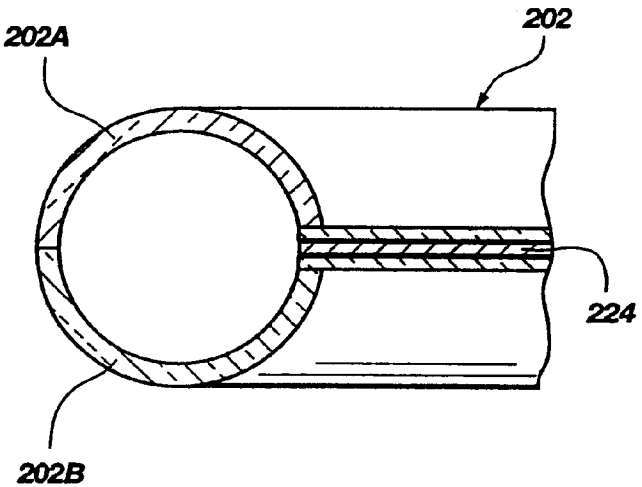
FIG. 25 is a sectional view, taken along the line 25—25, of the display frame portion of FIG. 23.

With reference to FIG. 25, the frame portion 202 is formed by joining a first frame half 202A and a second frame half 202B. A slot is formed between the two frame halves which enables the sign 224 to be inserted therein, as shown in FIG. 20.

In compliance with the statute, the invention has been described in language more or less specific as to structural and methodical features. It is to be understood, however, that the invention is not to be limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A point-of-purchase display assembly for extension transversely into a shopping aisle from a merchandise storage site, the assembly comprising;

a clamp which the assembly is proximally releasibly attached to a molding at the merchandise storage site along the shopping aisle;

an advertising carrier disposed at a distal portion of the assembly;

advertising information associated with the carrier;

a support interposed between the clamp and the carrier, the support removably and deflectibly holding the carrier so that the carrier normally cantilevers transversely into the shopping aisle;

at least one source of illumination which does not require observer-activation and is visible in both directions along the shopping aisle, the source of illumination being associated with the carrier, the at least one source of illumination being in electrical communication with a source of electrical power;

the support comprising a cylindrical housing in which the source of electrical power is located.

2. A point-of-purchase display assembly for extension transversely into a shopping aisle from a merchandise storage site, the assembly comprising;

a clamp by which the assembly is proximally releasibly attached to a molding at the merchandise storage site along the shopping aisle;

an advertising carrier disposed at a distal portion of the assembly;

advertising information associated with the carrier;

a support interposed between the clamp and the carrier, the support removably and deflectibly holding the carrier so that the carrier normally cantilevers transversely into the shopping in aisle;

at least one source of illumination which does not require observer-activation and is visible in both directions along the shopping aisle, the source of illumination being associated with the carrier, the at least one source of illumination being in electrical communication with a source of electrical power;

the support comprising a cylindrical housing and the electrical power is communicated to the source of illumination without activation by an observer from at least one battery located within the cylindrical housing.

* * * * *